US005819889A

United States Patent [19]

Shieh

[11] Patent Number: 5,819,889

[45] **Date of Patent: *Oct. 13, 1998**

[54] MOTORCYCLE DISK BRAKE LOCK

[76] Inventor: Jin-Ren Shieh, No. 178, Shih Chia Rd., Taichung, Taiwan

[ * ] Notice: The term of this patent shall not extend beyond the expiration date of Pat. No. 5,492,206.

[21] Appl. No.: 743,623

[22] Filed: Nov. 4, 1996

[51] Int. Cl.[6] ..... E05B 67/36

[52] U.S. Cl. ..... 188/265; 70/34

[58] Field of Search ..... 188/69, 265, 18 A; 70/33, 34, 36, 226, 228, 233

[56] References Cited

U.S. PATENT DOCUMENTS 5,442,941 8/1995 Kahonen et al. ..... 70/34
5,492,206 2/1996 Shieh ..... 188/265
5,530,427 6/1996 Shieh ..... 188/69 X

*Primary Examiner*—Lee W. Young
*Attorney, Agent, or Firm*—Browdy and Neimark

[57] ABSTRACT

A motorcycle disk brake lock comprises a main body and a locking tool. The main body is provided with a retaining slot, a first receiving cell, a through hole located between the retaining slot and the first receiving cell, and a recess located in the inner wall of the retaining slot such that the recess is opposite in location to the through hole. The locking tool is housed in the first receiving cell such that the lock core of the locking tool is capable of moving back and forth in the first receiving cell. The lock core is provided with a lock bolt which is fitted into a spring. The recess of the retaining slot is provided in the inner wall thereof with a first retaining portion engageable with a second retaining portion of the lock bolt.

6 Claims, 4 Drawing Sheets

MOTORCYCLE DISK BRAKE LOCK

FIELD OF THE INVENTION

The present invention relates generally to a motorcycle lock for disabling the motorcycle, and more particularly to a theft-proof motorcycle disk brake lock.

BACKGROUND OF THE INVENTION

As shown in FIG. 1, a motorcycle disk brake lock 1 of the prior art is composed of a U-shaped main body 2 and a locking tool 3 mounted on the main body 2. The main body 2 is provided with a retaining slot 4 for receiving therein the disk brake of a motorcycle. The retaining slot 4 is provided in the inner wall thereof with a recess 5. The locking tool 3 has a locking bolt 6 capable of moving back and forth in the retaining slot 4. In operation, the disk brake is received in the retaining slot 4 before the locking bolt 6 is put through the heat dispersing hole of the disk brake such that one end of the locking bolt 6 is retained securely in the recess 5, thereby enabling the disk brake lock 1 to incapacitate the disk brake of the motorcycle.

Such a prior art motorcycle disk brake lock as described above is defective in design in that it can be easily tampered with by means of a hand tool, which is inserted into the retaining slot 4 to force either side of the open end of the U-shaped main body 3 to move apart so as to cause the end of the locking bolt 6 to become disengaged with the recess 5, as illustrated in FIG. 2. In addition, the prior art disk brake lock 1 has a relatively long moment of force (L), which allows an unauthorized person to tamper with the lock easily by exerting a force on the wall of the upper portion of the retaining slot 4.

SUMMARY OF THE INVENTION

It is therefore the primary objective of the present invention to provide an improved motorcycle disk brake lock which can not be tampered with easily and is therefore relatively burglarproof.

In keeping with the principle of the present invention, the foregoing objective of the present invention is attained by a motorcycle disk brake lock, which comprises a main body and a locking tool. The main body is provided with a retaining slot, a first receiving cell, a through hole located between the retaining slot and the first receiving cell, and a recess located in the wall of the retaining slot such that the recess is opposite to the through hole. The locking tool is housed in the first receiving cell such that the lock core of the locking tool is capable of moving back and forth in the first receiving cell. The lock core is provided with a lock bolt which is fitted into a spring. The recess of the retaining slot is provided in the inner wall thereof with a first retaining portion engageable with a second retaining portion of the lock bolt.

The foregoing objective, features, functions and advantages of the present invention will be more readily understood upon a thoughtful deliberation of the following detailed description of the embodiments of the present invention in conjunction with the accompanying drawings.

DETAILED DESCRIPTION OF THE INVENTION

Figure 1:
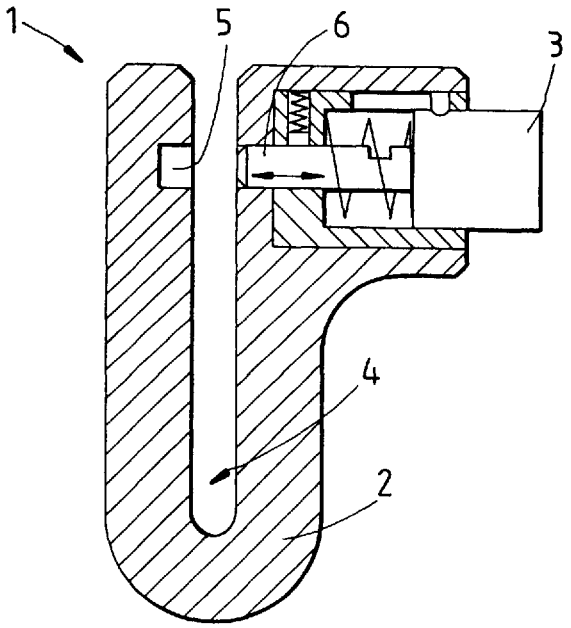
FIG. 1 PRIOR ART
FIG. 1 shows a sectional view of a motorcycle disk brake lock of the prior art.

As shown in FIGS. 3–6, a motorcycle disk brake lock 10 of the first preferred embodiment of the present invention is composed of a main body 12 and a locking tool 14 mounted on the main body 12.

The main body 12 is made integrally and provided with a retaining slot 20 of a predetermined length, a first receiving cell 22 of a cylindrical shape, a through hole 24 located between the bottom of the first receiving cell 22 and the retaining slot 20 such that the through hole 24 is coaxial with the first receiving cell 22 and that the through hole 24 is smaller in inner diameter than the first receiving cell 22. The retaining slot 20 is provided in the inner wall thereof with a recess 26 opposite in location to the through hole 24. The main body 12 is further provided with two cylindrical retaining members 30 having a longitudinal axis perpendicular to the axis of the recess 26. The inner end of each of the retaining members 30 is projected out of the inner wall of the recess 26. The length of the projected portion of the retaining members 30 is smaller than the radius of the recess 26 such that a gap (D1) is formed therebetween. The inner end of each of the retaining members 30 remains apart from the bottom of the recess 26 by an appropriate distance to form therebetween a second receiving cell 28. The retaining members 30 are provided respectively with a first retaining portion 301 facing the bottom of the second receiving cell 28.

The locking tool 14 has a sleeve 40 which is secured in the first receiving cell 22 by a fastening pin 42. The sleeve 40 is provided with a guide slot 44 extending along the direction of the longitudinal axis thereof and is further provided therein with a lock core 52 capable of sliding in the sleeve 40 and having a slide block 54 which is located on the periphery of the lock core 52 such that the slide block 54 is slidably received in the guide slot 44. The lock core 52 further has a lock bolt 56 capable of moving along with the lock core 52. The lock bolt 56 can be driven to swivel by a key (not shown in the drawing) which is received in the lock core 52. The lock bolt 56 has an inner end 561, a midsegment 562, and an outer end 563. The inner end 561 has an outer diameter smaller than that of the lock core 52. The lock core 52 has a first shoulder 521. The midsegment 562 is engageable with the recess 26 of the retaining slot 20 via the through hole 24 and is smaller in outer diameter than the inner end 561. The lock bolt 56 has a second shoulder 564 corresponding in location to the first receiving cell 22. The outer end 563 has an outer diameter smaller than the distance (D1) between the first retaining portions 301. The outer end 563 is provided with two protuberances opposite in location to each other and having a second retaining portion 565 facing the first retaining portion 301. The second retaining portion 565 is rotatably received in the first receiving cell 28. The length (D2) between the opposite outer edges of the two second retaining portions 565 is greater than the distance (D1) between the two first retaining portions 301 while the width (D3) is smaller than the distance (D1). The lock bolt 56 is fitted into a spring 58 which is located between the bottom of the first receiving cell 22 and the first shoulder 521 of the lock core 52 such that the lock core 52 is urged by the spring 58.

Figure 5:
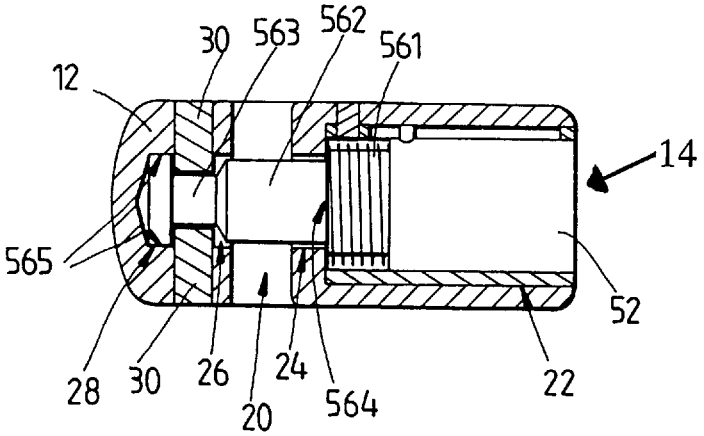
FIG. 5 shows a sectional view taken in the direction of the longitudinal axis of the locking tool of the first preferred embodiment to illustrate the locking state of the present invention.

In operation, the fringe of the disk brake of a motorcycle is first received in the retaining slot 20 before the lock bolt 56 is driven to slide leftwards by the key received in the lock core 52, thereby causing the second retaining portions 565 to pass through the heat dispersing hole of the disk brake to locate in the second receiving cell 28. Thereafter, the lock bolt 56 is rotated by the key to cause the second retaining portions 565 to swivel for an angle of 90 degrees to be corresponding in location to the first retaining portions 301, as shown in FIG. 5. As a result, the lock bolt 56 is retained securely in the recess 26.

Figure 2:
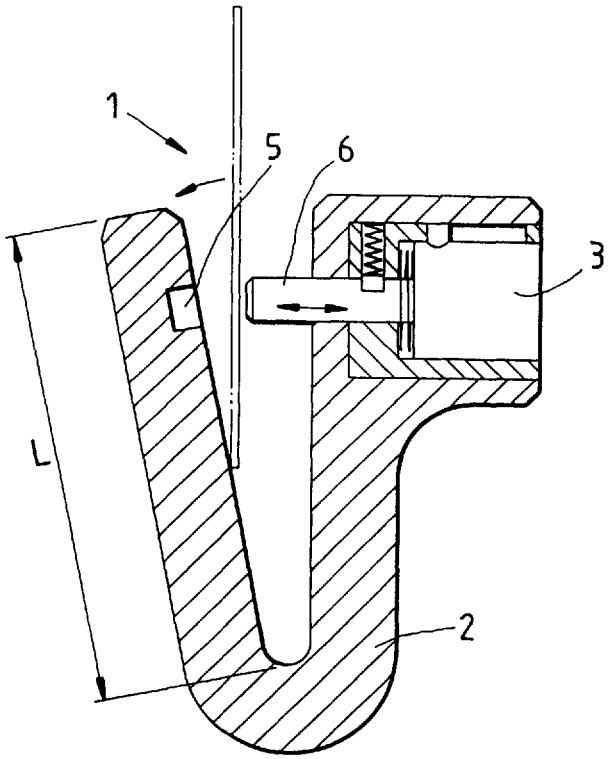
FIG. 2 PRIOR ART
FIG. 2 is a sectional view illustrating the vulnerability of the prior art motorcycle disk brake lock to being tampered with by an unauthorized person.
Figure 3:
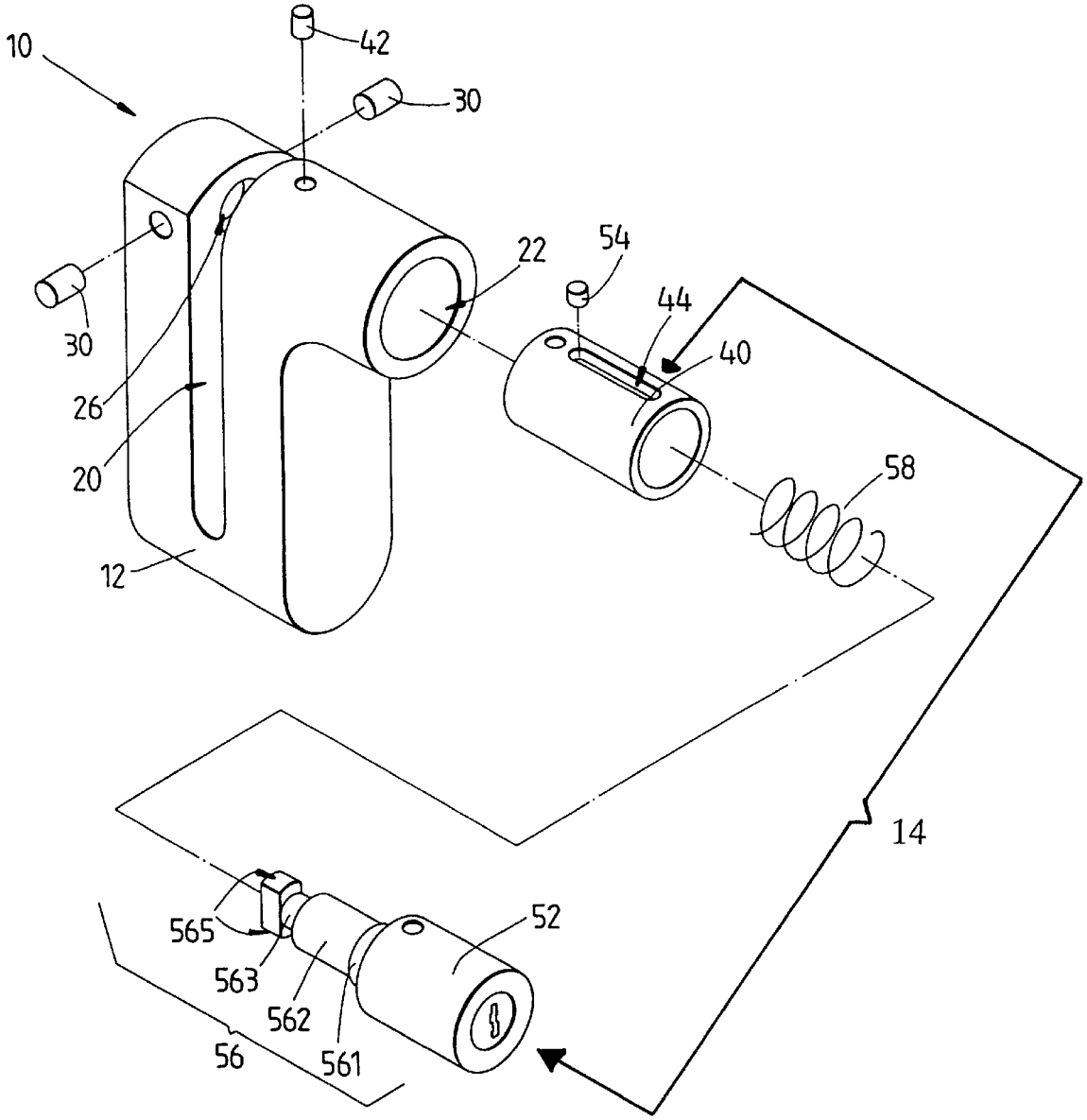
FIG. 3 shows an exploded view of a first preferred embodiment of the present invention.
Figure 4:
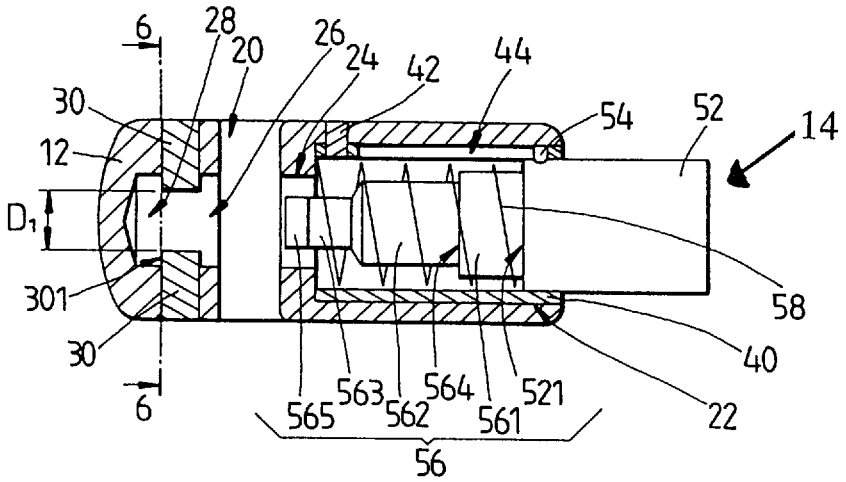
FIG. 4 shows a sectional view taken in the direction of the longitudinal axis of the locking tool of the first preferred embodiment to illustrate the unlocking state of the present invention.

When the lock of the present invention is kept in the locking state, the bottom of the first receiving cell 22 and each of the first retaining portions 301 are respectively corresponding in location to the portion between the second shoulders 564 and the second retaining portion 565 of the lock bolt 56. As a result, both sides of the main body 12 are held securely by the lock bolt 56 traversing the retaining slot 20. For this reason, both sides of the main body 12 can not be easily forced apart with a hand tool. In the meantime, the inner end 561 and the outer end 563 of the lock bolt 56 are located by the first receiving cell 22 and the retaining members 30, which are made integrally without the use of the spring of the prior art lock as shown in FIGS. 1 and 2. The lock of the present invention is therefore cost-effective.

When the locking tool 14 of the present invention is impacted, the spring 58 is protected by the bottom of the first receiving cell 22 and the second shoulder 564, which serve to alleviate the shock.

It is easy to remove the lock 10 of the present invention from a motorcycle disk brake with which the lock 10 is engaged. The lock bolt 52 is rotated in reverse by the key so as to relocate the second retaining portions 565 at the positions which are not opposite to the first retaining portions 301. The lock core 52 is then forced by the spring 58 to actuate the lock bolt 56 to move rightwards to cause the second retaining portions 565 to move out of the retaining slot 20.

Figure 8:
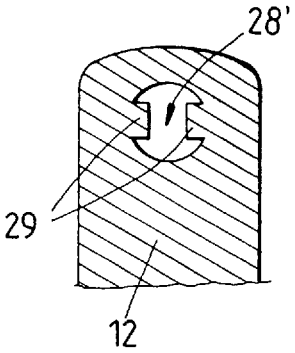
FIG. 8 shows a sectional view taken along the direction indicated by a line 8—8 as shown in FIG. 7.
Figure 6:
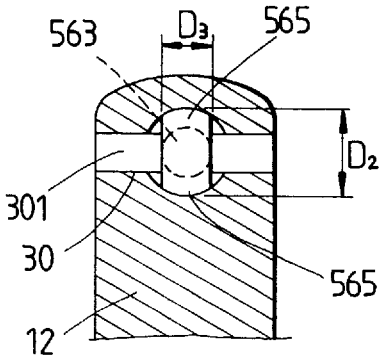
FIG. 6 shows a sectional view taken along the direction indicated by a line 6—6 as shown in FIG. 4.
Figure 7:
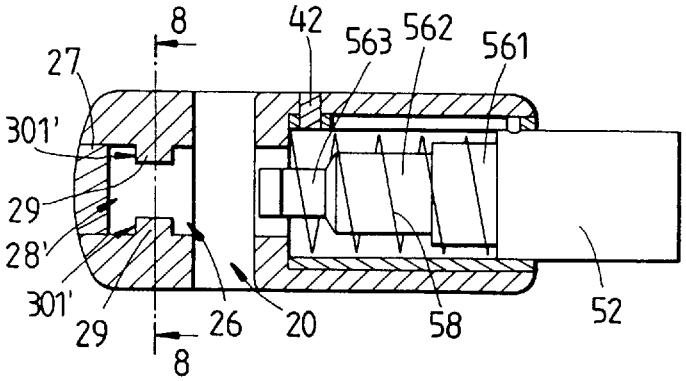
FIG. 7 shows a sectional view taken along the direction of the longitudinal axis of the locking tool of a second preferred embodiment of the present invention.
Figure 9:
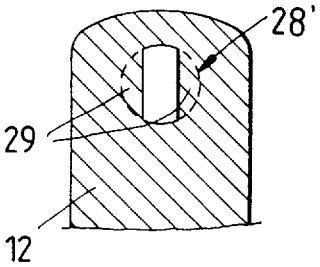
FIG. 9 shows a sectional view similar to FIG. 8 for illustrating a third preferred embodiment of the present invention.

The embodiment of the present invention described above is to be regarded in all respects as being merely illustrative and not restrictive. Accordingly, the present invention may be embodied in other specific forms without deviating from the spirit thereof. For example, the main body 12 may be provided with a recess 26' and a cylindrical second receiving cell 28', which are coaxially in communication with each other, as shown in FIGS. 7 and 8. The second receiving cell 28' is provided with a cap 27. The recess 26' is provided in the inner wall thereof with two stopping blocks 29 opposite to each other and having a first retaining portion 301' facing the bottom of the second receiving cell 28. As a result, the outer end of the lock bolt 56 is retained securely when the lock 10 is kept in the locking state. The stopping blocks 29 may be of any shape. The upper and the lower sides of the stopping blocks 29 may be directly connected on the inner wall of the recess 26', as shown in FIG. 9.

What is claimed is:

1. A motorcycle disk brake lock comprising:

a main body provided with a retaining slot, a first receiving cell extending towards said retaining slot, a through hole communicating said first receiving cell with said retaining slot and opposite in location to a recess located in an inner wall of said retaining slot;

a locking tool received in said first receiving cell and provided with a lock core capable of moving back and forth in said first receiving cell, said locking tool further provided with a lock bolt mounted on said lock core such that said lock bolt is capable of swiveling within a predetermined angular range along the direction of a longitudinal axis of said lock core and that said lock bolt is capable of moving back and forth in said first receiving cell along with said lock core; and a biasing means fitted over said lock bolt and located between a bottom of said first receiving cell and said locking tool;

wherein said main body is provided with at least one first retaining portion separated from a bottom of said recess by a predetermined distance, said main body further provided with a second receiving cell located between said first retaining portion and said bottom of said recess;

wherein said lock bolt has an inner end capable of being driven by said lock core, a midsegment capable of sliding in said through hole and said recess, and an outer end provided with a second retaining portion corresponding in location to said first retaining portion and capable of swiveling in said second receiving cell within a predetermined angular range along an axis of the said lock bolt.

2. The motorcycle disk brake lock as defined in claim 1, wherein said inner end of said lock bolt has an outer diameter smaller than an outer diameter of said lock core; and wherein said biasing means urges a first shoulder located at a connecting portion of said lock bolt and said lock core such that said first shoulder faces said bottom of said first receiving cell.

3. The motorcycle disk brake lock as defined in claim 1, wherein said midsegment of said lock bolt has an outer diameter smaller than an inner diameter of said through hole and an outer diameter of said inner end of said lock bolt; and wherein said lock bolt is provided with a second shoulder located at a connecting portion of said midsegment and said inner end such that said second shoulder faces a bottom of said first receiving cell.

4. The motorcycle disk brake lock as defined in claim 1, wherein said main body is provided thereon with a retaining member having an outer end fastened with said main body, said retaining member further having an inner end; and wherein said first retaining portion is located on said inner end of said retaining member such that said first retaining portion faces a bottom of said second receiving cell.

5. The motorcycle disk brake lock as defined in claim 4, wherein said retaining member is a rod having a portion extending beyond an inner wall of said recess, said portion having a length smaller than a radius of said recess.

6. The motorcycle disk brake lock as defined in claim 1, wherein said recess is provided in an inner wall thereof with a stopping block made; integrally therewith; and wherein said first retaining portion is located on said stopping block.

* * * * *